US007103289B2

(12) United States Patent
Hong

(10) Patent No.: US 7,103,289 B2
(45) Date of Patent: Sep. 5, 2006

(54) PRINTING PAPER LOADING DEVICE, PRINTER HAVING THE SAME AND METHOD OF SETTING IDS OF PLURAL PAPER LOADING DEVICES

(75) Inventor: Choon-ho Hong, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 754 days.

(21) Appl. No.: 10/197,505

(22) Filed: Jul. 18, 2002

(65) Prior Publication Data

US 2003/0098540 A1 May 29, 2003

(30) Foreign Application Priority Data

Nov. 29, 2001 (KR) ..... 2001-74819

(51) Int. Cl.
*G03G 15/00* (2006.01)

(52) U.S. Cl. ..... 399/12; 399/391; 399/393

(58) Field of Classification Search ..... 399/12, 399/393, 391
See application file for complete search history.

(56) References Cited

U.S. PATENT DOCUMENTS 3,622,238 A * 11/1971 Alman et al. ..... 399/391
4,736,255 A * 4/1988 Miura et al.
4,821,068 A * 4/1989 Honma et al.
6,477,335 B1 * 11/2002 Surya et al. ..... 399/12

FOREIGN PATENT DOCUMENTS

JP 08-166860 6/1996
JP 2001-156721 6/2001
JP 2003-50684 2/2003

OTHER PUBLICATIONS

Japanese Office Action issued with respect to the Japanese Patent Application No. 2002-260311 (Issue Date: Jun. 8, 2004).

* cited by examiner

*Primary Examiner*—Susan Lee
(74) *Attorney, Agent, or Firm*—Staas & Halsey LLP

(57) ABSTRACT

A printing apparatus having plural printing paper loading devices and a main controller. Each of the printing paper loading devices has a sub-controller to generate a test signal, and an inverting circuit of an open collector type to generate an output signal by performing an inverting operation with respect to an input signal. The printing paper loading devices are consecutively connected so that the output signal of one of the printing paper loading devices becomes the input signal input into another of the printing paper loading devices. The inverting circuit outputs a low level signal regardless of the level of the test signal when the input signal is high level, and outputs a signal of a same level as the test signal when the input signal is of the low level. Each of the sub-controllers sets its own ID based on the level of the output signal of the printing paper loading device corresponding thereto. The main controller receives the IDs set by the sub-controllers through a common bus. As the IDs of the printing paper loading devices are automatically set, a user does not have to set the IDs. In addition, malfunction of the printing apparatus caused by mistakes in setting the IDs can be prevented.

25 Claims, 7 Drawing Sheets

FIG.6

| Vin | Vout | RECEIVING TERMINAL |
|---|---|---|
| H | L | L |
| L | LEVEL OF TEST SIGNAL (H OR L) | LEVEL OF TEST SIGNAL (H OR L) |

FIG.9

| | Before Operation S65 (Test Sig.=H for all Cassettes) | After Operation 65 (Test. Sig.=L for Cassette 2, only) |
|---|---|---|
| VOUT OF CASSETTE 1 | L | L |
| VOUT OF CASSETTE 2 | H | L |
| VOUT OF CASSETTE 3 | L | H |

PRINTING PAPER LOADING DEVICE, PRINTER HAVING THE SAME AND METHOD OF SETTING IDS OF PLURAL PAPER LOADING DEVICES

CROSS-REFERENCE TO RELATED APPLICATIONS

This application claims the benefit of Korean Application No. 2001-74819, filed Nov. 29, 2001, in the Korean Industrial Property Office, the disclosure of which is incorporated herein by reference.

BACKGROUND OF THE INVENTION

1. Field of the Invention

The present invention relates to a printing apparatus such as a printer or a photocopying machine, and more particularly, to a printing apparatus having plural printing paper loading devices to store printing papers, and a method of setting IDs of the plural printing paper loading devices.

2. Description of the Related Art

A printing apparatus such as a printer or a photocopying machine to output letters and pictures on printing papers has a printing paper loading device to store papers used in printing. When the printing apparatus performs the printing, the printing papers stored in the printing paper loading device are taken out by a printing paper delivery device, such as a roller, and are transmitted to a printing unit. Known designs include a printing apparatus having plural printing paper loading devices. Since various types of printing papers can be loaded into the plural printing paper loading devices, a user can select the proper size and type of paper for the particular print job.

The printing apparatus having the plural printing paper loading devices has a selection means for the user to select a desired printing paper loading device from among the numerous printing paper loading devices. For example, when the user selects one of the printing paper loading devices by using a manipulation button provided on a manipulation panel of the printing apparatus, a printing paper loaded in the selected printing paper loading device is used during the printing operation.

However, in the printing apparatus having the plural printing paper loading devices, IDs (Identification Codes) for each of the printing paper loading devices should be set in advance before the user inputs a selection command with respect to the printing paper loading devices. The printing paper loading devices are consecutively given numbers, starting at 1. For example, 1 is given to a printing paper loading device placed at the highest position, and 2 is given to a next printing paper loading device. The IDs can be set while the printing paper loading devices are being manufactured, or can be set afterwards for the user's convenience when the printing paper loading devices are additionally installed in accordance with the user's needs.

FIG. 1 is a block diagram schematically showing the conventional printing apparatus having conventional plural printing paper loading devices. The printing apparatus in FIG. 1 has three printing paper loading devices. The printing apparatus includes a main controller 10, first through third printing paper loading devices 20A–20C, and first through third cassette controllers 22, 24 and 26 respectively disposed in the printing paper loading devices 20A–20C.

The main controller 10 controls overall operations related to printing, such as interfacing printing data with a host connected with the printing apparatus, data processing, controlling various motors, and controlling various sensors. The first through third cassette controllers 22, 24 and 26 are independently connected with the main controller 10 through three data buses 15*a*, 15*b* and 15*c*. The controllers 22, 24 and 26 control the operation of a printing paper delivery motor (not shown) and a printing paper delivery sensor (not shown) in each of the printing paper loading devices 20A–20C, in accordance with a command transmitted from the main controller 10.

In the above printing apparatus, the data buses 15*a*, 15*b* and 15*c* are allocated to each of the printing paper loading devices 20A–20C. Accordingly, the main controller 10 can set the IDs with respect to each of the first through third printing paper loading devices 20A–20C.

FIG. 2 is a view showing another example of a conventional printing apparatus having the conventional printing paper loading devices. As in FIG. 1, the printing apparatus has a main controller 30, first through third printing paper loading devices 40, and first through third cassette controllers 42, 44 and 46, respectively disposed in each of the printing paper loading devices 40. Moreover, the cassette controllers 42, 44 and 46 are connected with the main controller 30 through a common data bus 35. Each of the cassette controllers 42, 44 and 46 has ID set-up switches 41, 43 and 45 to manually set an ID.

In the above printing apparatus, as the main controller 30 and each of the cassette controllers 42, 44 and 46 transmit data through the common data bus 35, the main controller 30 can recognize the IDs of the printing paper loading devices 40 according to a set-up state of the ID set-up switches 41, 43 and 45. The main controller 30 also transmits the data to the proper one of the printing paper loading devices 40 to be controlled based on a recognized ID.

In the case of FIG. 1, when the main controller 10 and each of the cassette controllers 22, 24 and 26 respectively have the independent data buses 15*a*, 15*b* and 15*c*, the cost of manufacturing the printing apparatus increases as the number of the data buses 15*a*, 15*b* and 15*c* increases. In addition, when an additional printing paper loading device is installed afterwards, an additional data bus must be provided.

In the case of FIG. 2, when the separate ID set-up switches 41, 43 and 45 are installed in the printing paper loading devices 40, the user has to manually set the IDs for the respective printing paper loading devices 40. Additionally, when the user mistakenly sets a same ID for different ones of the printing paper loading devices 40, the command of the main controller 30 is transmitted to plural ones of the printing paper loading devices 40, which may cause serious damage to the printing apparatus.

SUMMARY OF THE INVENTION

Accordingly, it is the object of the present invention to provide a printing apparatus which can avoid the increased cost of manufacturing a plurality of data lines, and the inconvenience of setting individual IDs, and moreover, which is capable of preventing a malfunction caused by mistakes in setting the IDs.

It is another object of the present invention to provide a printing paper loading device used in the above printing apparatus.

Still another object of the present invention is to provide a method of automatically setting the ID of each of the printing paper loading devices in the above printing apparatus.

Additional objects and advantages of the invention will be set forth in part in the description which follows and, in part, will be obvious from the description, or may be learned by practice of the invention.

The foregoing objects and advantages can be achieved by providing a printing paper loading device, including a controller including a test terminal to output a test signal having signal levels of a high level or a low level, and a receiving terminal to receive a signal input thereto, the controller to set an ID based on a level of the signal input into the receiving terminal; and an inverting circuit to receive an input signal input from an outside and the test signal, and to generate an output signal output to the outside, the inverting circuit to provide the output signal to the receiving terminal, wherein the inverting circuit outputs the output signal having the low level when the input signal has the high level, and outputs the output signal of a same level as the test signal when the input signal has the low level.

The foregoing objects and advantages may also be achieved by providing a printing apparatus, including a common bus; a plurality of printing paper loading devices each including a sub-controller to generate a test signal having signal levels of a high level or a low level, and inverting circuits to generate an output signal output to an outside by performing an inverting operation with respect to the test signal and an input signal input from the outside; and a main controller to communicate with the sub-controllers through the common bus, wherein the printing paper loading devices are consecutively connected to each other to allow the output signal of one of the printing paper loading devices to be input into another of the printing paper loading devices as the input signal thereof, each of the inverting circuits outputs the output signal having the low level when the input signal input thereto has the high level, and outputs the output signal of a same level as the test signal when the input signal input thereto has the low level, each of the sub-controllers sets an ID based on a level of the output signal of the printing paper loading device corresponding thereto and the main controller receives the IDs respectively set by the sub-controllers through the common bus.

According to the present invention, the production cost of the printing apparatus is reduced. Moreover, a user does not have to set the ID individually, and the malfunction of the printing apparatus caused by mistakes when the user sets the ID can be prevented.

The foregoing objects and advantages may also be achieved by providing a method of setting an ID of a plurality of printing paper loading devices in a printing apparatus, the method including preparing the plurality of printing paper loading devices respectively having an inverting circuit to receive an input signal input from an outside and a predetermined test signal, the inverting circuit to generate an output signal output to the outside, the printing paper loading devices being consecutively connected such that the output signal of one of the printing paper loading devices becomes the input signal of another one of the printing paper loading devices; inputting the input signal to the printing paper loading device disposed at a front end according to a connection order, and the test signal to each of the inverting circuits; and setting the ID of each of the printing paper loading devices based on a level of the output signals respectively output from each of the inverting circuits.

BRIEF DESCRIPTION OF THE DRAWINGS

These and other objects and advantages of the invention will become apparent and more readily appreciated from the following description of the preferred embodiments, taken in conjunction with the accompanying drawings of which:

FIG. 6 is a table showing input and output relations of the printing paper loading devices of FIG. 5;

FIG. 9 is a table showing levels of output signals of each of the printing paper loading devices while the method of setting the IDs according to FIG. 8 is being performed.

DETAILED DESCRIPTION OF THE PREFERRED EMBODIMENTS

Figure 1:
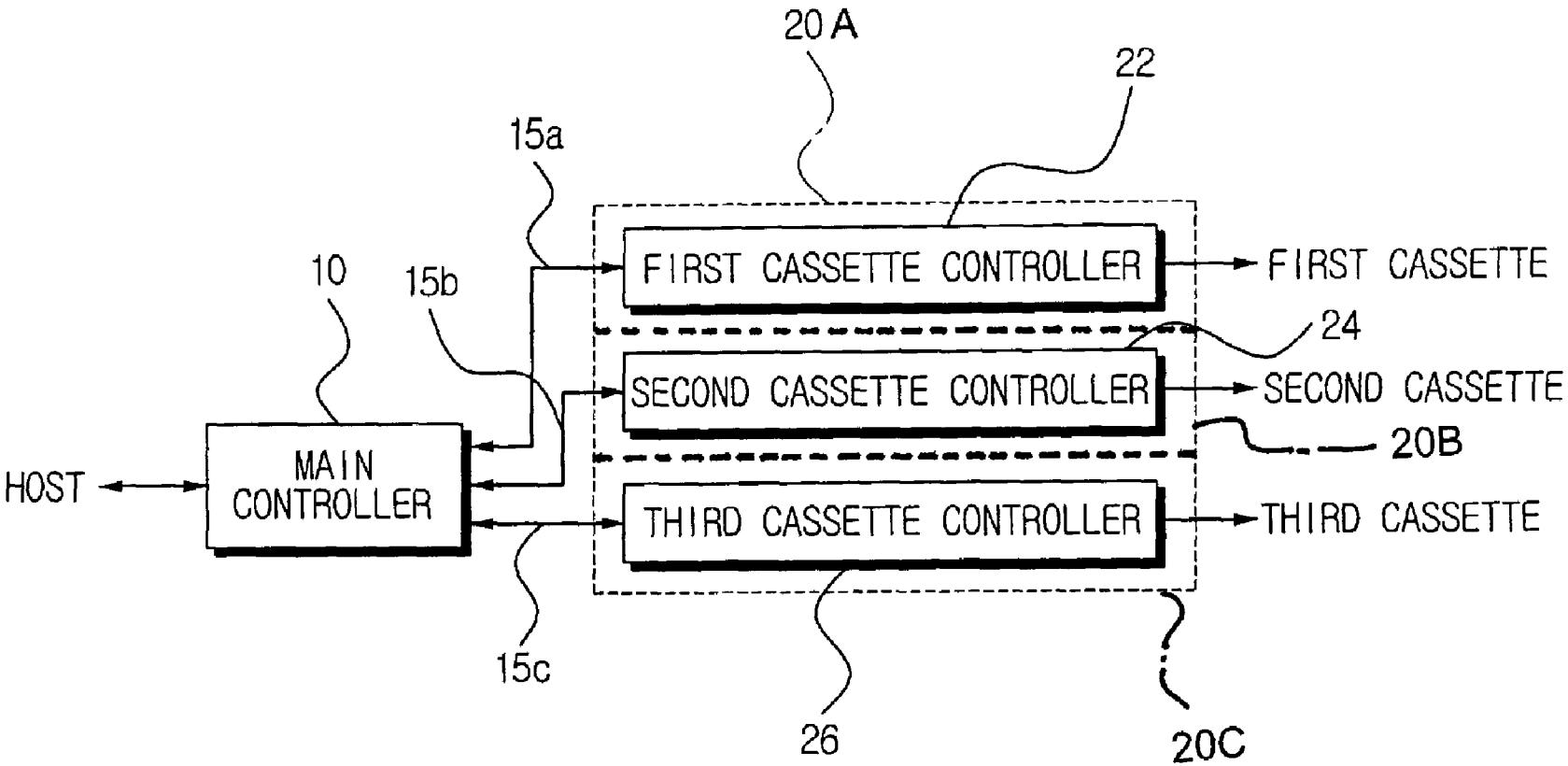
FIG. 1 (PRIOR ART)
FIG. 1 is a block diagram of a conventional printing apparatus having plural printing paper loading devices.
Figure 2:
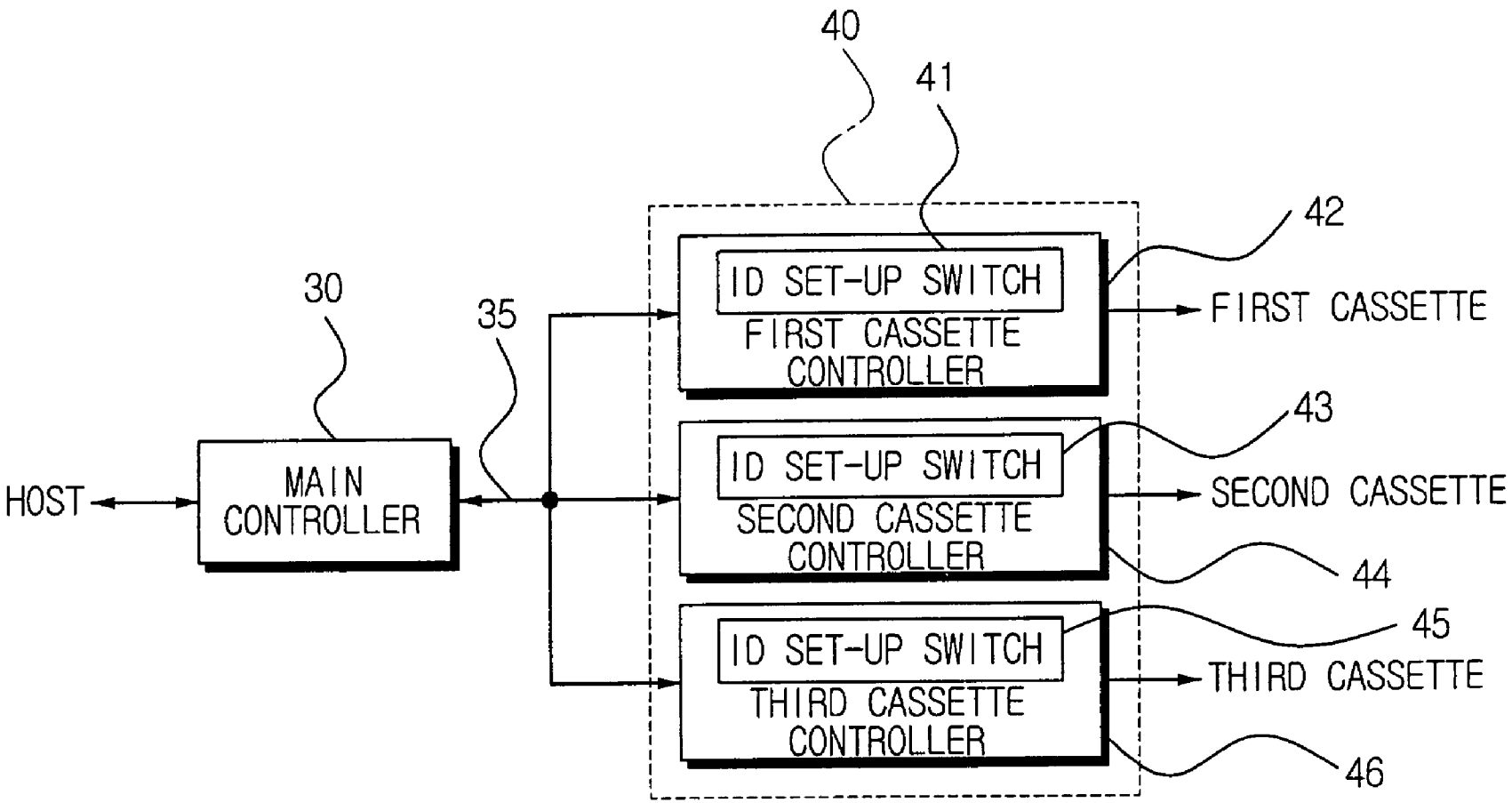
FIG.2 (PRIOR ART)
FIG. 2 is a block diagram of another conventional printing apparatus having plural printing paper loading devices.

Reference will now be made in detail to the present preferred embodiments of the present invention, examples of which are illustrated in the accompanying drawings, wherein like reference numerals refer to like elements throughout.

The printing apparatus according to the present invention can be applied to all kinds of apparatuses which are used to print letter data or image data on paper such as a printer, a photocopying machine, or a facsimile machine. First, printing paper loading devices included in the printing apparatus of an embodiment of the present invention will be described, and the description of the printing apparatus will follow.

Figure 3:
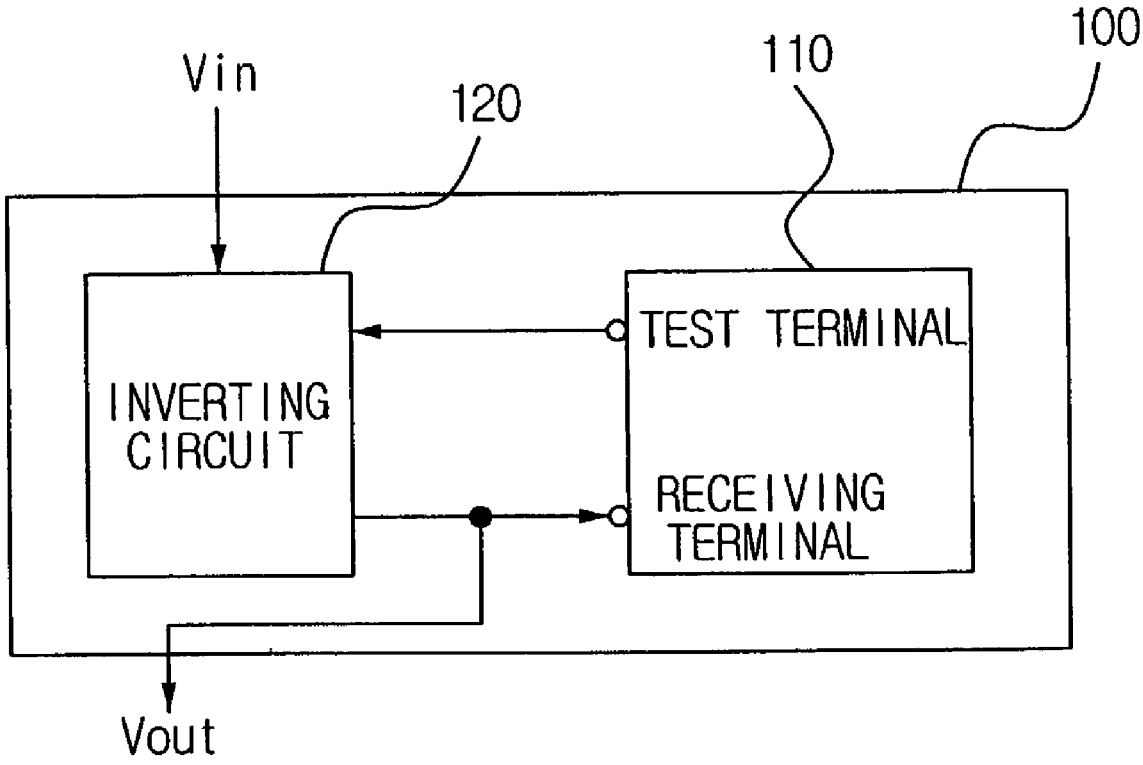
FIG. 3 is a block diagram showing a printing paper loading device according to an embodiment of the present invention.

FIG. 3 is a view schematically showing the printing paper loading device according to an embodiment of the present invention. The printing paper loading device installed in the printing apparatus generally has the shape of a cassette, and thus the terms 'printing paper loading device' and 'cassette' will be used interchangeably.

The printing paper loading device 100 has a sub-controller 110, an inverting circuit 120, a paper tray (not shown) to accommodate papers, and a paper delivery portion (not shown) constructed with elements such as a roller and a sensor required to remove the accommodated papers.

As shown in FIG. 3, the sub-controller 110 has a test terminal to output a predetermined test signal, and a receiving terminal to receive a signal input from the inverting circuit 120. The test signal output from the sub-controller 110 has a high or low signal level. The test signal is provided to the inverting circuit 120. The sub-controller 110 sets its own ID based on the level of the signal transmitted to the receiving terminal, as will be described later.

An input signal (Vin) input from an outside of the cassette 100 is input into the inverting circuit 120. The inverting circuit 120 outputs an output signal (Vout) to an outside of the cassette 100. In this situation, the inverting operation of the inverting circuit 120 depends on the input signal (Vin) and the test signal.

Figure 4:
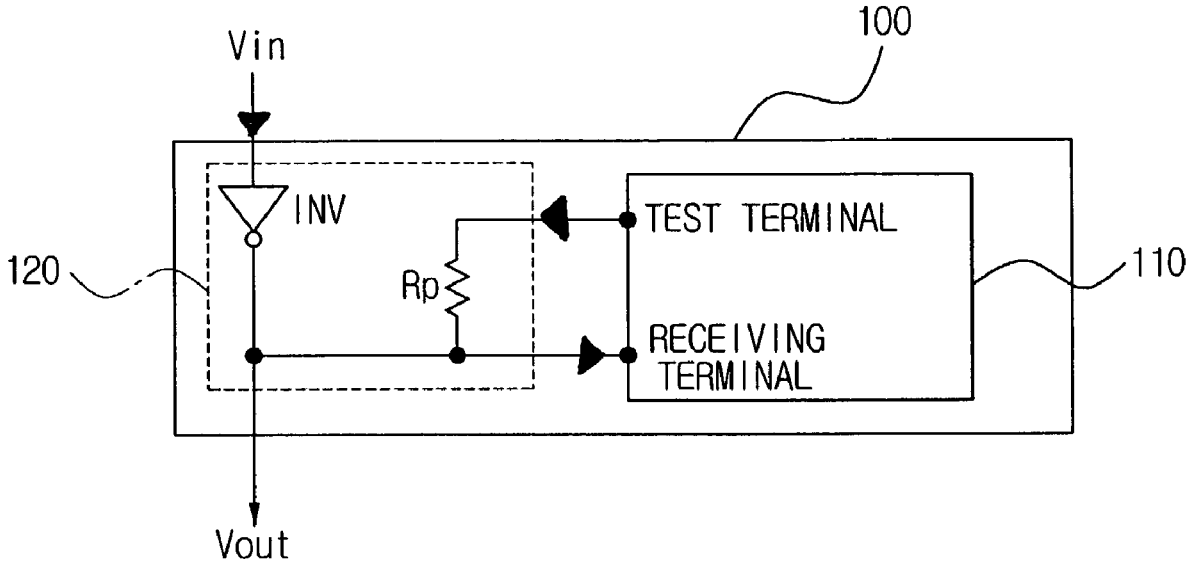
FIG. 4 is a circuit diagram of the inverting circuit of FIG. 3.
Figure 5:
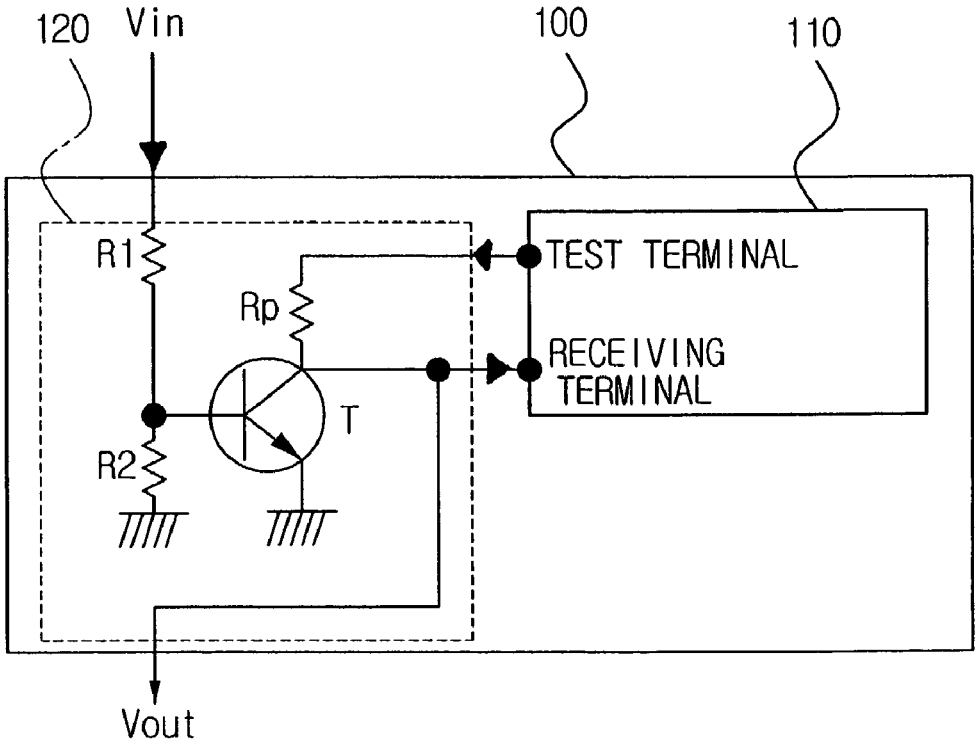
FIG. 5 is a circuit diagram of an inverter of FIG. 4 having a transistor of an open collector type.

FIGS. 4 and 5 are views showing the inverting circuit 120 of FIG. 3 in great detail. As shown in FIG. 4, the inverting circuit 120 includes an inverter (INV) and a resistor (Rp). The resistor (Rp) is disposed between an output terminal of the inverter (INV) and the test terminal.

As shown in FIG. 5, the inverter (INV) includes a transistor of an open collector type. In FIG. 5, the inverter (INV) is constructed with resistors R1 and R2 to divide the input voltage (Vin), and a switching transistor (T). The voltage input into the inverter (INV) is converted into a voltage with an appropriate magnitude to drive the switching transistor (T) by the resistors R1 and R2.

The voltage across the resistor R2 is input into the base of the switching transistor (T), and the resistor (Rp) is connected with the collector of the switching transistor (T). The receiving terminal of the sub-controller 110 is also connected with the collector of the switching transistor (T).

In FIG. 5, the switching transistor (T) is a bi-polar transistor of an open collector type in which the emitter is grounded. However, the switching transistor (T) may also be another type of transistor capable of a switching operation. For example, the switching transistor (T) of FIG. 5 can be realized by using a field effect transistor that controls the flow of electric current between a drain and a source as the voltage of the resistor R2 is connected to a gate. In this case, the switching transistor (T) becomes a transistor of an open drain type, in which the resistor R2 is connected with the drain.

When the voltage input into the inverting circuit 120 is at the high level, the switching transistor (T) is turned on, and accordingly, the voltage output from the test terminal of the sub-controller 110 flows to a grounded terminal through the resistor Rp and the switching transistor (T). Therefore, the voltage of the test signal is lowered by the resistor Rp, and the voltage output from the collector of the switching transistor (T) is low level.

When the voltage input (Vin) into the inverting circuit 120 is low level, the switching transistor (T) is turned off, and accordingly, the flow of the voltage output from the test terminal of the sub-controller 110 is blocked. Therefore, the output voltage (Vout) output from the collector of the switching transistor (T) becomes high level when the voltage of the test signal is high level. The output voltage (Vout) output from the collector of the switching transistor (T) becomes low level when the voltage of the test signal is low.

FIG. 6 is a table showing the operation of the inverting circuit 120. According to the operation of the inverting circuit 120, as shown in FIG. 6, when the input signal (Vin) is high level, the output signal (Vout) becomes low level, since the input signal (Vin) is inverted. When the input signal (Vin) is low level, the output signal (Vout) becomes the same level as the test signal. The output signal (Vout) of the inverting circuit 120 is input into the receiving terminal of the sub-controller 110, thus the signal level of the receiving terminal is the same as the level of the output signal (Vout).

Figure 7:
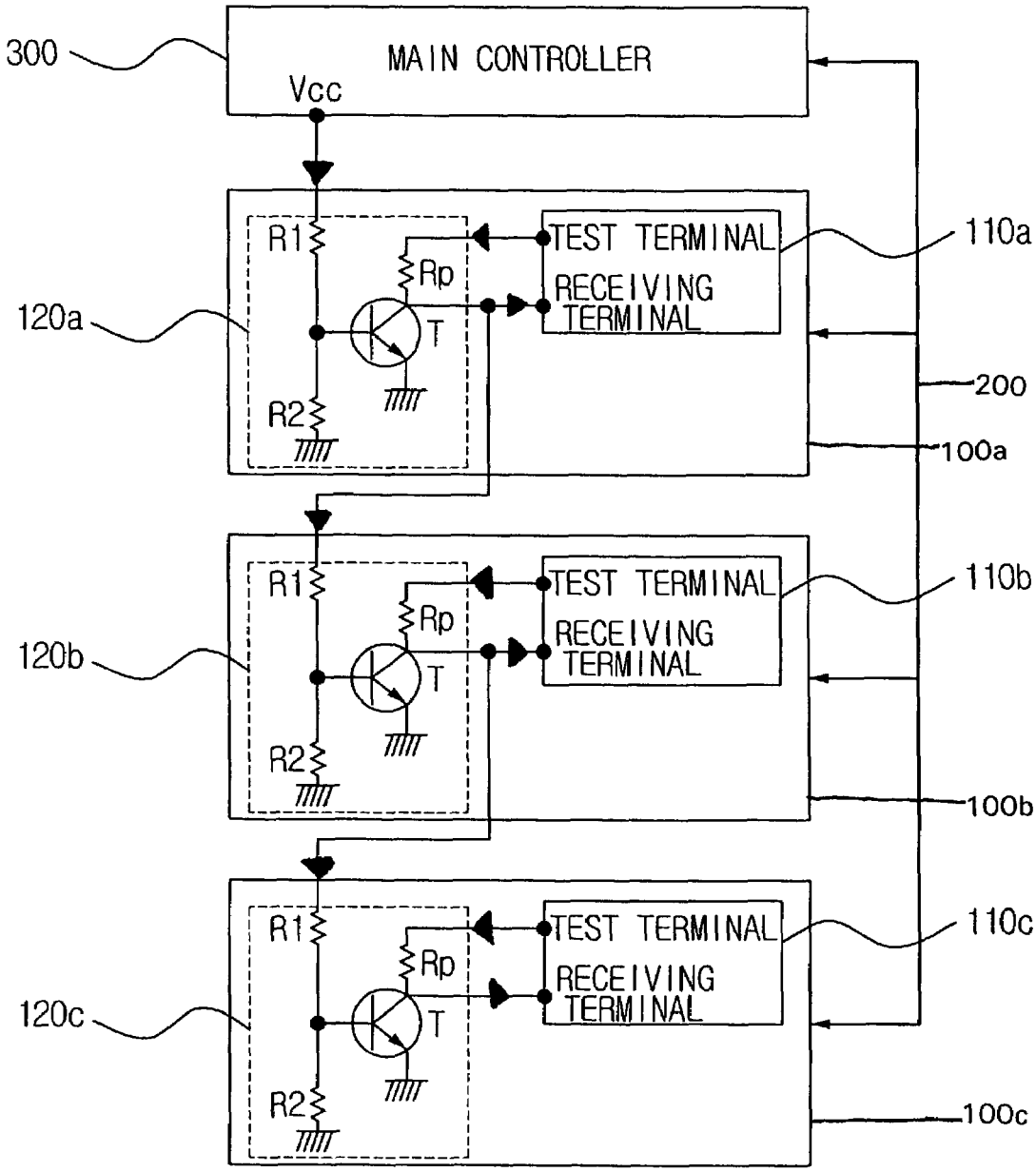
FIG. 7 is a block diagram showing a printing apparatus having the printing paper loading devices of FIG. 5.

FIG. 7 shows the printing apparatus applying the printing paper loading device 100 shown in FIGS. 3 through 5. The printing apparatus has three printing paper loading devices 100*a*, 100*b* and 100*c*, and a main controller 300 to communicate with the printing paper loading devices 100*a*, 100*b* and 100*c*. The printing paper loading devices 100*a*, 100*b* and 100*c* and the main controller 300 are connected with each other through a common bus 200, and perform a serial communication through the common bus 200. The printing apparatus includes a printing portion to print data on the papers, and other mechanical and electrical parts to perform other functions that are not shown in FIG. 7.

The three printing paper loading devices 100*a*, 100*b* and 100*c* are the same as the printing paper loading device 100 shown in FIG. 3. Yet, controllers 110*a*, 110*b* and 110*c* installed in the printing paper loading devices 100*a*, 100*b* and 100*c* have a function of a sub-controller to communicate with the main controller 300.

The printing paper loading devices 100*a*, 100*b* and 100*c* are consecutively stacked, and are consecutively connected so that the output signal of one of the printing paper loading devices 100*a*, 100*b* and 100*c* becomes the input signal of another one of the printing paper loading devices 100*a*, 100*b* and 100*c*. In other words, the output signal of a first cassette 100*a* becomes the input signal of a second cassette 100*b*, and the output signal of the second cassette 100*b* becomes the input signal of a third cassette 100*c*. In addition, a driving voltage (Vcc) output from the main controller 300 is input into the first cassette 100*a* and serves as an input voltage.

Figure 8:
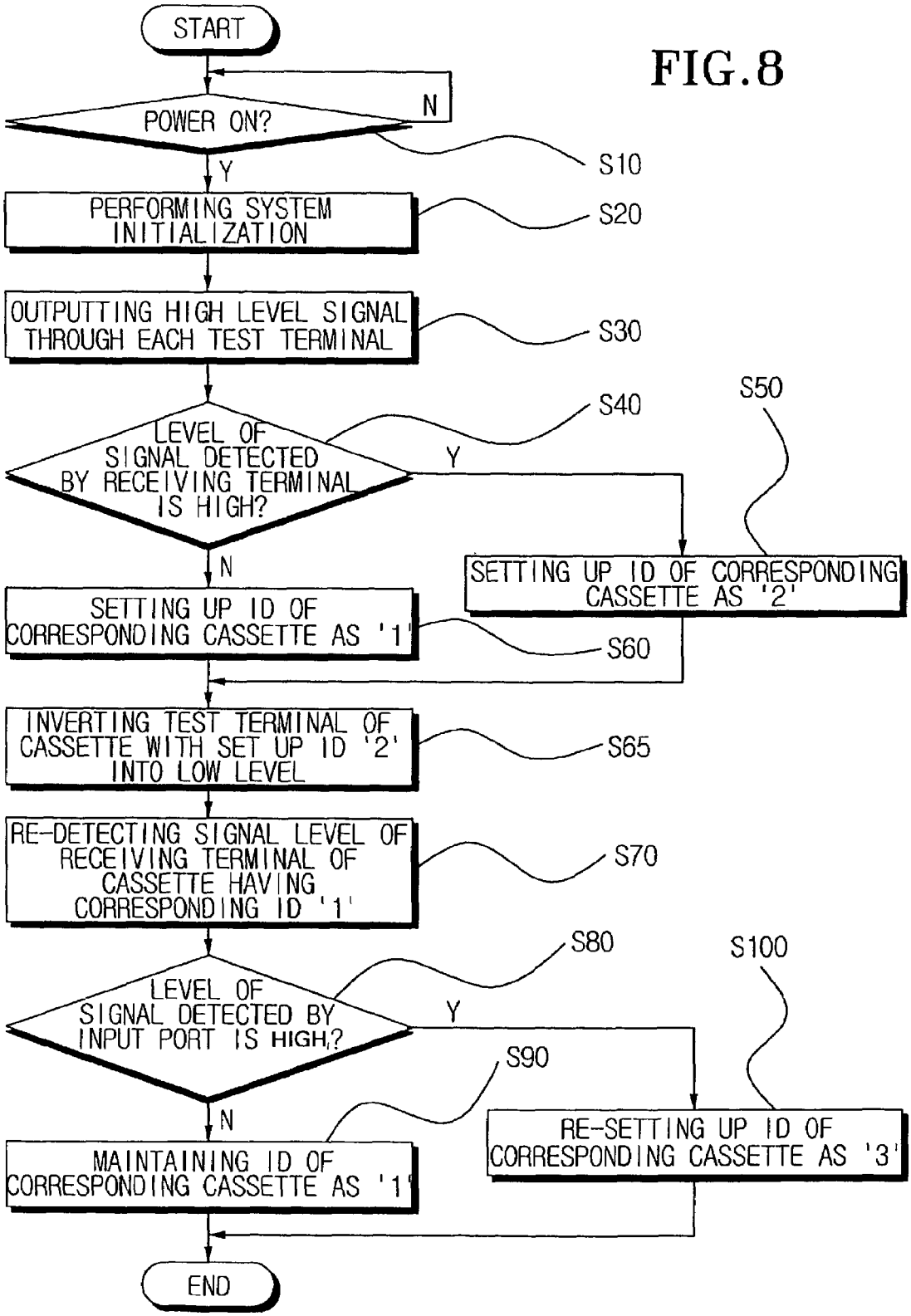
FIG. 8 is a flow chart showing a method of setting IDs of the plural printing paper loading devices disposed in the printing apparatus according to the embodiment of FIG. 3.

Hereinbelow, the method of setting IDs of the printing paper loading devices 100*a*, 100*b* and 100*c* will be described referring to FIGS. 8 and 9.

When a user turns on the printing apparatus (S 10), the main controller 300 and each of the sub-controllers 110*a*, 110*b* and 110*c* perform the initialization of the system (S 20). After that, the main controller 300 and the sub-controllers 110*a*, 110*b* and 110*c* perform the set-up of the IDs.

First, each of the sub-controllers 110*a*, 110*b* and 110*c* generates a test signal of a high level through the respective test terminals (S 30). As shown in FIG. 9, as the driving voltage (Vcc) of the high level is input into the inverter 120*a* of the first cassette 100*a*, the output signal (Vout) of the first cassette 100*a* is low level, since the input signal thereof is inverted. As the low level signal is input into the inverter 120*b* of the second cassette 100*b*, the output signal (Vout) of the second cassette 100*b* is high, which is the same level as the level of the test signal in the second cassette 100*b*. As the high level signal is input into the inverter 120*c* of the third cassette 100*c*, the output signal (Vout) of the third cassette 100*c* is low level, since the input signal thereof is inverted.

As described so far, when the test signals of all of the sub-controllers 110*a*, 110*b*, 110*c* are set as high level, each of the inverters 120*a*, 120*b* and 120*c* alternately outputs signals of the high level and the low level. Therefore, among the sub-controllers 110*a*, 110*b* and 110*c*, only the sub-controller 110*b* of the second cassette 100*b*, which is even-numbered, receives the signal of the low level.

The sub-controllers 110*a*, 110*b* and 110*c* detect the level of the signal input to the receiving terminals thereof (S 40), and then the sub-controller 110*b*, which has received the signal of the low level, sets its own ID as '2' (S 50). Additionally, the sub-controllers 110*a* and 110*c*, which have received the input signal of the high level, set their own IDs as '1' (S 60).

Then, the sub-controller 110*b*, which has set its own ID as '2', inverts the level of the test signal output from the test terminal thereof to the low level (S 65). Accordingly, as shown in FIG. 9, the first cassette 100*a* continuously outputs the signal of the low level, since the high driving signal (Vcc) is input continuously. The second cassette 100*b* outputs the signal of the low level, since the input signal and the test signal are low level. The third cassette 100*c* outputs the signal of the high level, since the input signal is low level and the test signal is high level.

Accordingly, as the test signal of the sub-controller 110*b*, which has set its own ID as '2', is inverted, the signal of the high level is input into the receiving terminal of the sub-controller 110*c* of the third cassette 100*c*, and the signal of the low level is continuously input into the receiving terminal of the sub-controller 110*a* of the first cassette 100*a*.

The sub-controllers 110*a* and 110*c*, which have IDs of '1', re-detect the level of the signal input into their own receiving terminals (S 70), and judge whether the re-detected signal is high level (S 80). When the level is high, the sub-controllers 110*a* and 110*c* set their own ID as '3' (S 100). When the level is low, the sub-controllers 110*a* and 110*c* maintain the IDs as '1'. Accordingly, the IDs of all cassettes 100*a*, 100*b* and 100*c* are set by the sub-controllers 110*a*, 110*b* and 110*c*.

Each of the sub-controllers 110*a*, 110*b* and 110*c* transmits the set IDs of the main controller 300 through the common bus 200, and the main controller 300 can recognize the IDs of each of the sub-controllers 110*a*, 110*b* and 110*c*. After that, when the user inputs a command to select a certain cassette through a manipulation panel (not shown) provided on the printing apparatus, the main controller 300 transmits a control command to the selected cassette by referring to the set ID so that the printing paper can be removed from the selected cassette, when the printing apparatus performs the printing operation.

In the embodiment of the present invention described above, it has been exemplified that the IDs are set with respect to three cassettes 100*a*, 100*b* and 100*c*. However, the present invention can be applied to a printing apparatus having two, or four, or even more of the cassettes. In the case when the printing apparatus has four or more of the cassettes, certain ones of the above operations should be repeated.

For example, when the printing apparatus has five cassettes, first, the operations of assigning the ID '2' through the test signal of the high level, and assigning the ID '3' by inverting the test signals of the cassettes of which IDs have been set as '2' are performed. Next, the IDs '4' and '5' are assigned with respect to cassettes that do not yet have IDs. While these operations are being performed, the sub-controller corresponding to an unchanged output signal (in other words, the sub-controller in which the level of the signal input thereto through the receiving terminal is not changed) sets the respective ID as '1'. Accordingly, all five of the cassettes consecutively set their own IDs.

According to the present invention, the IDs of the printing paper loading devices of the printing apparatus are automatically set. Moreover, as the main controller and each of the cassettes are connected with a single bus, the manufacturing costs are reduced compared with the conventional printing apparatus having a plurality of data lines. Additionally, the user does not have to set the IDs of the printing paper loading devices individually, and the malfunction of the printing apparatus caused by mistakes in setting the IDs can be prevented.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A method of setting IDs in a printing apparatus having a plurality of printing paper loading devices, the method comprising:

inputting input signals into each of the printing paper loading devices;

inputting test signals into each of the printing paper loading devices;

generating output signals from each of the printing paper loading devices in response to the input and the test signals; and setting the IDs based on the output signals.

2. The method according to claim 1, wherein the generating of the output signals comprises generating an output signal having a second level when the respective input signal has a first level, and generating an output signal having a same level as the respective test signal when the respective input signal has the second level.

3. The method according to claim 2, further comprising:

inverting the test signal input to a one of the printing paper loading devices having an even-numbered ID; and re-setting the ID of one of the printing paper loading devices that is consecutively connected to the printing paper loading device having the even-numbered ID.

4. A printing paper loading device, comprising:

a controller comprising:

a test terminal to output a test signal having a signal level of a high level or a low level, and a receiving terminal to receive a first input signal input thereto, the controller to set an ID based on a level of the first input signal; and an inverting circuit to receive a second input signal input from an outside thereof and the test signal, and to generate an output signal output to the outside, the inverting circuit to provide the output signal to the receiving terminal, wherein the output signal has the low level when the second input signal has the high level, and the output signal has a same level as the test signal when the second input signal has the low level.

5. The printing paper loading device according to claim 4, wherein the inverting circuit comprises:

an inverter having an output terminal, to perform an inverting operation with respect to the second input signal and to output the output signal through the output terminal; and a resistor disposed between the output terminal and the test terminal.

6. The printing paper loading device according to claim 5, wherein the inverter comprises a switching transistor, which is turned on and passes the test signal when the second input signal has the high level, and is turned off to block the test signal when the second input signal has the low level.

7. A printing apparatus, comprising:

a common bus;

a plurality of printing paper loading devices each comprising:

a sub-controller to generate a test signal having a signal level of a high level or a low level, and an inverting circuit to generate an output signal output to an outside by performing an inverting operation with respect to the test signal and an input signal input from the outside; and a main controller to communicate with the sub-controllers through the common bus, wherein the printing paper loading devices are consecutively connected to each other to allow the output signal of one of the printing paper loading devices to be input into another one of the printing paper loading devices as the input signal thereof, the output signals having the low level when the input signal input thereto has the high level, and the output signals having a same level as the test signal when the input signal input thereto has the low level, each of the sub-controllers sets a respective ID based on the level of the output signal of the printing paper loading device corresponding thereto, and the main controller receives the IDs respectively set by the sub-controllers through the common bus.

8. The printing apparatus according to claim 7, further comprising a first output terminal to output the test signal, and wherein the inverting circuits each comprise:

an inverter having a second output terminal to perform the inverting operation with respect to the input signal and to output the output signal through the second output terminal; and a resistor disposed between the first and second output terminals.

9. The printing apparatus according to claim 8, wherein the inverter further comprises a switching transistor, which is turned on and passes the test signal when the input signal has the high level, and is turned off to block the test signal when the input signal has the low level.

10. The printing apparatus according to claim 7, wherein the printing paper loading devices are no more than three in number.

11. A method of setting IDs of a plurality of printing paper loading devices each having an inverting circuit, in a printing apparatus, the method comprising:

generating an input signal and a test signal;

inputting the input signal from an outside to the inverting circuits;

inputting the test signal to the inverting circuits;

generating an output signal from the inverting circuits to the outside;

connecting the printing paper loading devices such that the output signal of one of the printing paper loading devices becomes the input signal of another one of the printing paper loading devices; and setting the ID of each of the printing paper loading devices based on a level of the output signals respectively output from each of the inverting circuits.

12. The method according to claim 11, wherein the generating of the output signal comprises generating the output signal having a low level when the input signal input thereto has a high level; and generating the output signal of a same level as the test signal when the input signal input thereto has the low level.

13. The method according to claim 12, wherein the inputting of the input signal comprises inputting a signal having the high level;

the inputting of the test signal comprises inputting a signal having the high level; and the setting of the ID comprises assigning the ID corresponding to an even-numbered order with respect to the printing paper loading devices having the output signal having the high level.

14. The method according to claim 13, further comprising:

inverting the test signals input into the inverting circuits to which the ID corresponding to the even-numbered order has been assigned, to the low level, wherein the setting of the ID further comprises assigning the ID corresponding to a next printing paper loading device of the even-numbered order after the inverting of the test signals.

15. The method according to claim 14, wherein the setting of the ID further comprises assigning the ID corresponding to a first one of the printing paper loading devices after the inverting of the test signals.

16. The method according to claim 15, wherein the printing paper loading devices are no more than three in number, and the even-numbered order is the second one of the printing paper loading devices.

17. A printing paper loading device, comprising:

a circuit to receive first and second signals and to generate a third signal in response to the first and second signals, the first, second and third signals each having a first or a second level; and a controller to set an ID of the device, comprising:

a first terminal to generate the second signal, and a second terminal to receive the third signal, the controller setting the ID based on the level of the third signal, the third signal having the second level when the first signal has the first level, and the third signal having a same level as the second signal when the first signal has the second level.

18. The printing paper loading device according to claim 17, wherein the circuit comprises:

an inverter to invert the first signal; and a resistor disposed between the inverter and the first terminal.

19. The printing paper loading device according to claim 18, wherein the inverter comprises a transistor of an open collector type.

20. The printing paper loading device according to claim 19, wherein the transistor is switched on when the first signal has the first level, and is switched off when the first signal has the second level.

21. A printing apparatus, comprising:

a plurality of printing paper loading devices, each comprising:

a circuit to receive first and second signals and to generate a third signal in response to the first and second signals, the first, second and third signals each having a first or a second level, and a sub-controller to set an ID of the respective printing paper loading device, comprising:

a first terminal to generate the second signal, and a second terminal to receive the third signal, the sub-controller setting the ID based on the level of the third signal;

a main controller to receive the set IDs; and a bus to connect the main controller and the printing paper loading devices.

22. The printing apparatus according to claim 21, wherein the third signal has the second level when the first signal has the first level, and the third signal has a same level as the second signal when the first signal has the second level.

23. The printing apparatus according to claim 21, wherein the first signal of one of the printing paper loading devices is the third signal of another one of the printing paper loading devices.

24. The printing apparatus according to claim 21, wherein the printing apparatus is a facsimile machine, a photocopying machine, or a printer.

25. A method of setting an ID in a printing apparatus having a plurality of printing paper loading devices, the method comprising:

inputting an input signal into a first one of the printing paper loading devices;

generating an output signal from the first printing paper loading device in response to the input signal;

inputting the output signal into a second one of the printing paper loading devices; and setting an ID of the second printing paper loading device based on the output signal.

* * * * *